US009797224B1

(12) United States Patent
Stewart et al.

(10) Patent No.: US 9,797,224 B1
(45) Date of Patent: Oct. 24, 2017

(54) WELLHEAD STABILIZING SUBSEA MODULE

(71) Applicant: Ensco International Incorporated, Wilmington, DE (US)

(72) Inventors: Christopher Scott Stewart, Cornelius, NC (US); Justin Dow Alcorn, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/295,740

(22) Filed: Oct. 17, 2016

(51) Int. Cl.
*E21B 33/035* (2006.01)
*E21B 33/064* (2006.01)
*E21B 41/00* (2006.01)

(52) U.S. Cl.
CPC ..... *E21B 41/0007* (2013.01); *E21B 33/064* (2013.01)

(58) Field of Classification Search
CPC .... E21B 33/035; E21B 33/037; E21B 33/043; E21B 33/064; E21B 41/0007; E21B 41/08
See application file for complete search history.

(56) References Cited

U.S. PATENT DOCUMENTS 3,353,364 A * 11/1967 Blanding ..... B63C 11/44 114/314
4,461,354 A * 7/1984 Buras ..... E21B 19/16 166/343
5,244,046 A * 9/1993 Council ..... E21B 19/22 166/380
9,057,243 B2 * 6/2015 Hendel ..... E21B 33/064
9,068,424 B2 * 6/2015 Steele ..... E21B 33/038
9,080,408 B2 * 7/2015 Mogedal ..... E21B 19/002
9,140,089 B2 * 9/2015 Strand ..... E21B 33/035
9,284,806 B2 * 3/2016 Gutierrez ..... E21B 29/10
9,359,852 B2 * 6/2016 Kebadze ..... E21B 33/064
2012/0037375 A1 * 2/2012 Reynolds ..... E21B 33/064 166/341
2012/0055679 A1 * 3/2012 Van Winkle ..... E21B 33/0355 166/363
2012/0111572 A1 * 5/2012 Cargol, Jr. ..... E21B 33/0355 166/363
2013/0299177 A1 * 11/2013 Lyle ..... E21B 33/064 166/338
2013/0305829 A1 * 11/2013 Eriksen ..... E21B 33/064 73/700
2016/0061007 A1 * 3/2016 Moller ..... E21B 41/04 166/339
2016/0237788 A1 * 8/2016 Cenac ..... F15B 1/00

FOREIGN PATENT DOCUMENTS

WO WO2016106267 * 6/2016

* cited by examiner

*Primary Examiner* — Matthew R Buck
(74) *Attorney, Agent, or Firm* — Fletcher Yoder, P.C.

(57) ABSTRACT

Techniques and systems to provide additional holding ability to a subsea wellhead system. A device includes an auxiliary frame that may be coupled to an outer portion of a BOP frame that encloses at least a portion of a BOP. The auxiliary frame may also house a plurality of accumulators that may be used to provide pressurized fluid to the BOP.

20 Claims, 7 Drawing Sheets

WELLHEAD STABILIZING SUBSEA MODULE

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP).

Subsea BOPs perform many functions that allow the wellbore to be secured during normal and emergency drilling operations. Due to demanding drilling programs, regulatory requirements, and/or further reasons, additional functionality is being demanded of these BOPs. These increased demands may lead to increased capability requirements for the BOP.

DETAILED DESCRIPTION

Figure 1:
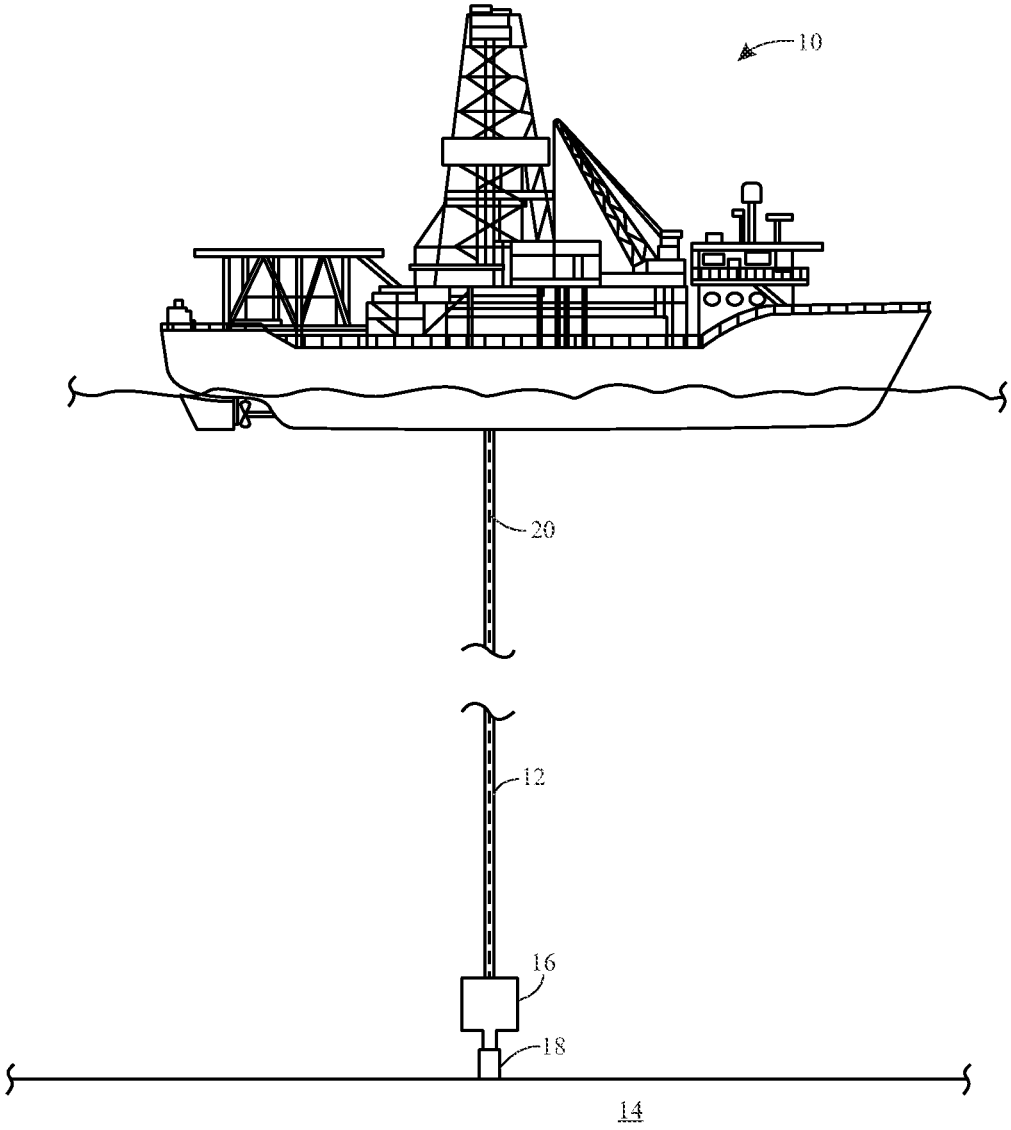
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Demands for increased capabilities of blowout preventers (BOPS) are continuing and the operation of BOPs include multiple functions that allow for a wellbore to be secured during normal operations, as well as emergency situations. Some of these demands take the form of increases in hydraulic pressures utilized by, for example, rams of one or more BOPs in a BOP stack and/or control systems of the BOP. To accommodate additional pressures, additional subsea accumulator volume may be added. However, presently there are practical limits associated with the addition of accumulator volume due to, for example, to space and/or weight constraints of the BOP stack and/or the wellhead. Accordingly, the present system and techniques provide a support structure, that may include one or more stabilizing frames, that can be added to a BOP to allow for additional accumulator volume, while preventing unnecessary loads from being transmitted to the BOP stack and/or the wellhead.

The presently disclosed support structure may include one or more cantilevered beams that are connected to a frame of the BOP. In some embodiments, the beams may be releasably coupled to the frame via a fastener, a slot and pin system, or another fastening mechanism. The support structure may also include a support assembly, which may include an actuator, such as a protracting cylinder or spud cylinder, as well as a foot or other support member that may interface with the seafloor. The support assembly may provide a foundation that helps distribute loads at least from the accumulators to the seafloor.

The support structure may house and/or otherwise contain subsea high pressure accumulators, which may be connected by a high pressure hose, such as a remotely operated vehicle (ROV) flying lead, hard piping, or the like, to main and/or emergency control systems of the BOP. The accumulators may be charged from a main hydraulic supply, an ROV pumping system, a surface hotline, or any other subsea or surface source. The accumulators may then be used to provide pressurized fluid to the main and/or emergency BOP control systems as desired and/or as requested or needed. This allows for greater numbers of accumulators present, which aids in increasing the flexibility and capability of the BOP as demand for increased operational pressures continues to rise.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a spar platform, a floating production system, or the like may be substituted for the drillship. Indeed, while the techniques and systems described below are described in conjunction with a drillship, the techniques and systems are intended to cover at least the additional offshore platforms 10 described above.

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool 19) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18.

Figure 2:
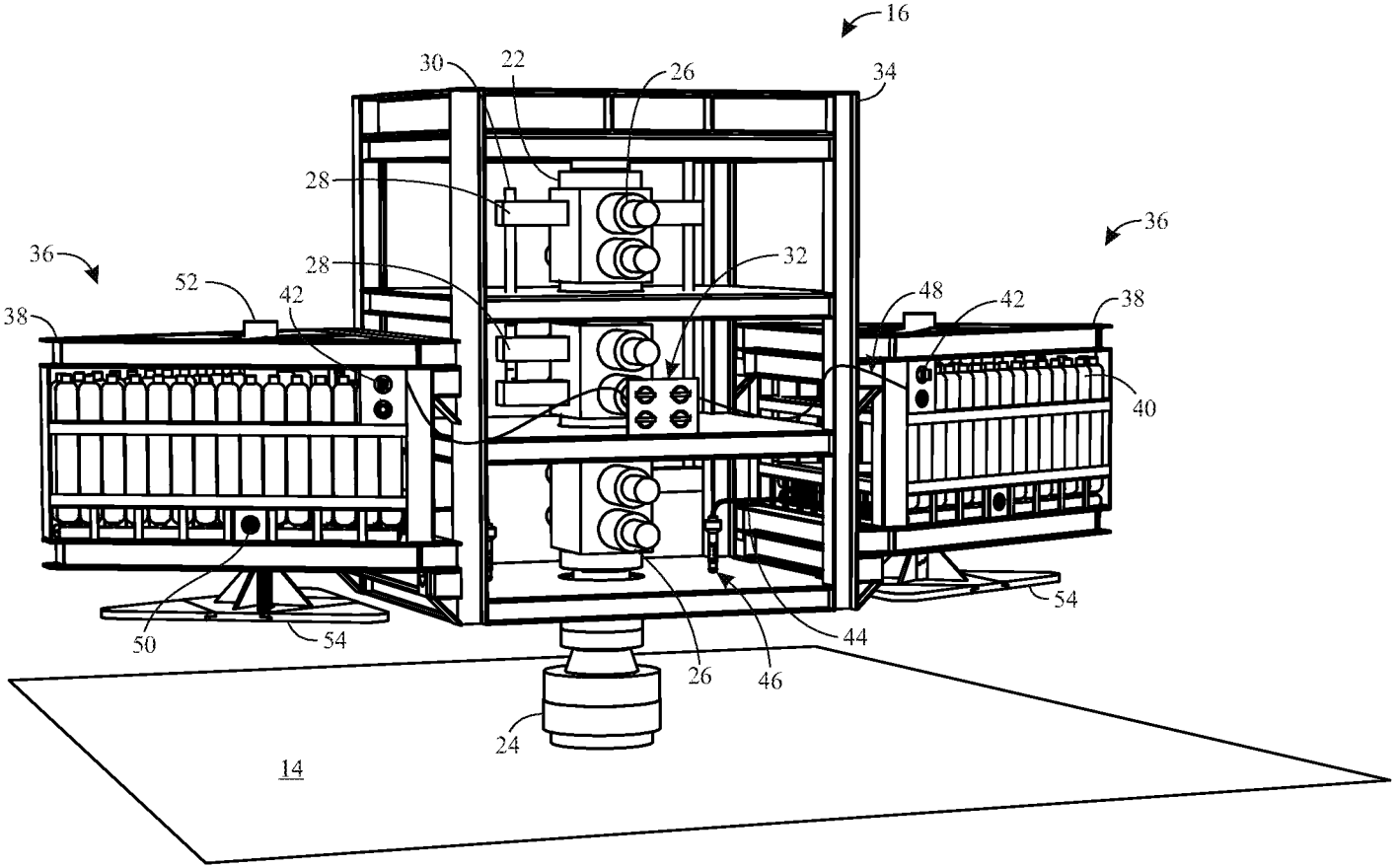
FIG. 2 illustrates a front view of the BOP of FIG. 1, in accordance with an embodiment.

FIG. 2 illustrates a front view of the BOP 16 of FIG. 1. As illustrated, the BOP 16 may include a BOP stack 22, such as a lower BOP stack, that may be coupled to an upper BOP stack. In some embodiments, the BOP stack 22 may operate either independently or in combination with an additional stack (e.g., an upper BOP stack that may include a lower marine riser package inclusive of, for example, a riser connector to allow for fluid connection between the riser 12 and the BOP stack 22, one or more annular BOPs that may consist of a large valve used to control wellbore fluids through mechanical squeezing of a sealing element about, for example, drill pipe 20, a ball/flex joint that allows for angular movement of the riser 12 with respect to the BOP 16, for example, due to movement of the offshore platform 10, at least one control, such as a BOP control pod, that operates as an interface between control lines that supply hydraulic and electric power and signals from the offshore platform 10 and the BOP 16 and/or other subsea equipment to be monitored and controlled) to control fluid flow into and out of the wellhead 18.

The BOP stack 22 may be coupled to the wellhead 18 (not illustrated) via a wellhead connector assembly 24. Furthermore, the BOP stack 22 may include one or more ram preventers 26, which may include a set of opposing rams that are designed to close within a bore (e.g., a center aperture region about drill pipe 20) of the BOP 16, for example, through hydraulic operation. Each of the ram preventers 26 may include cavities through which the respective opposing rams may pass into the bore of the BOP 16. These cavities may include, for example, shear ram cavities that house shear rams (e.g., hardened tool steel blades designed to cut/shear the drill pipe 20 then fully close to provide isolation or sealing of the offshore platform 10 from the wellbore 18). The ram preventers 26 may also include, for example, pipe ram cavities that house pipe rams (e.g., horizontally opposed sealing elements with a half-circle holes therein that mate to form a sealed aperture of a certain size through which drill pipe 20 passes) or variable bore rams (e.g., horizontally opposed sealing elements with a half-circle holes therein that mate to form a variably sized sealed aperture through which a wider range of drill pipes 20 may pass). The ram preventers 26 may be single-ram preventers (having one pair of opposing rams), double-ram preventers (having two pairs of opposing rams), triple-ram preventers (having three pairs of opposing rams), quad-ram ram preventers (having four pairs of opposing rams), or may include additional configurations.

The BOP stack 22 may further include failsafe valves 28. These failsafe valves 28 may include, for example, choke valves and kill valves that may be used to control the flow of well fluids being produced by regulating high pressure fluids passing through the conduit 30 arranged laterally along the riser 12 to allow for control of the well pressure. The ram preventers 26 may include vertically disposed side outlets that allow for the failsafe valves 28 to be coupled to the BOP stack 22. Typically, the failsafe valves 28 are arranged in a staggered configuration along the side outlets of the ram preventers 26 such that the failsafe valves 28 are disposed on opposing sides of the ram preventers 26 and in separate vertical planes from one another. However, alternate configurations may be employed.

The BOP 16 may further include a remotely operated vehicle (ROV) panel 32 that may be used to interface with an ROV. The ROV panel 32 may be part of a control system of the BOP 16 that provides an ROV compatible interface for the control of one or more components of, for example, the BOP stack 22. The ROV panel 32 may include one or more gauges, hot stab receptacles to allow the ROV to interface (e.g., hydraulically and/or electronically) with the BOP 16 and/or a control system of the BOP 16, directional valves that allow the ROV to manually control circuit functions, and tubing that may be sheared to vent circuits via, for example, an ROV end effector, ROV torque receptacles, ROV operable ball valves, and the like. In some embodiments, the ROV panel 32 may be coupled to a frame 34 (e.g., a BOP frame) that encloses (e.g., surrounds) at least a portion of the BOP 16 (e.g., an upper BOP stack, a lower BOP stack, such as BOP stack 22, or both an upper BOP stack and a lower BOP stack). As illustrated, space within the frame 34 may be limited. Accordingly, in some embodiments, a support structure 36 that may include one or more stabilizing frames 38 (e.g., an auxiliary frame), can be added to the BOP 16 (e.g., coupled to an outer portion of the frame 34) to allow for additional space to store, for example, accumulators 40 (e.g., subsea high pressure accumulators).

The accumulators 40 may be part of an accumulator system that operates as a pressure vessel to store the hydraulic pressure to close one or more ram preventers 26 of the BOP 16 in the event of a blowout. The accumulators 40 may be, for example, an arrays of bladder-type accumulator bottles that may be used in conjunction and pressurized with a dry nitrogen pre-charge as an on demand pressure source for a control system of the BOP 16 (e.g., to actuate the ram preventers 26). In some embodiments, the stabilizing frames 38 support and/or otherwise contain or house the accumulators 40. Likewise, the accumulators 40 may be charged from a main hydraulic supply of the BOP 16, an ROV pumping system, a surface hotline, or any other subsea or surface system. The accumulator 40 stored energy may then be used to provide, for example, pressurized fluid to the main and/or emergency BOP 16 control system on demand.

Additionally, as the BOP 16 may operate at 5,000 psi, 10,000 psi, 15,000 psi, and even higher pressures, 10, 20, 30, or even greater numbers of accumulators 40 may be used to provide the pressures for operation of the BOP 16 and/or its control system(s). However, as the total volume of the accumulators 40 increases, the space to house the accumulators 40 within frame 34 may become insufficient. Accordingly, as illustrated in FIG. 2, the support structure 36, and more particularly, the stabilizing frame 38, may house the accumulators 40.

The stabilizing frame 38 may include one or more beams, such as one or more cantilevered beams, that are connected to the frame 34 of the BOP 16. As illustrated in FIG. 2, the support structure 36 includes two stabilizing frames 38 disposed on opposite sides of the frame 34. However, in some embodiments, stabilizing frames 38 may be disposed on each side of the frame 34 such that four stabilizing frames 38 are employed for a four sided frame 34. Likewise, in other embodiments, other numbers of stabilizing frames 38 (e.g., one stabilizing frame 38, three stabilizing frames 38, etc.) may be utilized.

In some embodiments, the stabilizing frame 38 may be coupled to the frame 34 via a fixed connection (e.g., the stabilizing frame 38 and the frame 34 may be fixedly coupled via welding, brazing, soldering, riveting, adhesive, or the like). In other embodiments, the stabilizing frame 38 may be coupled to the frame 34 via a releasable connection (e.g., the stabilizing frame 38 and the frame 34 may be releasably coupled via one or more fasteners, such as bolts, screws, pins, or the like, a fastener, a slot and pin system, or another fastening mechanism).

Additionally, for example, when the support structure 36 is to be utilized in a grid of wells, the number of stabilizing frames 38 and/or the size of the stabilizing frames 38 may be adjusted so as not to interfere with adjacent wells. Moreover, for example, in the embodiment where the support structure 36 includes one or more stabilizing frames 38 that may be coupled to the frame 34 via a releasable connection, the support structure 36 may be coupled to the frame 34 at the offshore platform 10 (e.g., in the moonpool 19) or subsequent to deployment of the BOP 16 to the wellhead 18 on the seafloor 14 (e.g., where the connection may be facilitated through the use of an ROV and/or through use of similar techniques). In some embodiments, when attachment of the support structure 36 at the surface (e.g., in the moonpool 19) performed or when a fixed connection is utilized to couple the support structure 36 to the frame 34 of the BOP 16 prior to deployment of the BOP 16, advantages may be realized. For example, savings in overall deployment and/or extraction time (and, thus, costs) may be realized relative to, for example, use of a subsea accumulator module housing accumulators 40 that is adjacent to but physically separate from BOP 16.

That is, if a separate subsea accumulator module housing accumulators 40 is utilized in conjunction with the BOP 16 (e.g., whereby the separate subsea accumulator module is physically distinct from and coupled to the BOP 16 via one or more hoses, wires, and/or other connections in place of support structure 36), additional costs arising from time spent and/or additional complexities in deploying the separate subsea accumulator module may be amassed. For example, secondary offshore vessels, launch and recovery systems (LARS) for deployment and/or recovery of the separate subsea accumulator module, deployment and recovery of one or more mudmats on which the separate subsea accumulator module rests, and, in some embodiments, separate control modules for the BOP 16 and the separate subsea accumulator module may be eliminated when utilizing the support structure 36 in place of a separate subsea accumulator module.

As further illustrated in FIG. 2, the support structure 36 may also include an ROV panel 42 that may be used to interface with an ROV. The ROV panel 42 may be part of a control system of the BOP 16 and/or the support structure and may provide an ROV compatible interface for the control of one or more components of, for example, support structure 36 (e.g., the operation of the accumulators 40). Control of the operation of the accumulators 40 may include control of the transmission of pressurized fluid to the BOP 16 via connection 44, which may be a high pressure hose, such as an ROV flying lead or hard piping, to a connector 46, which may be a weight set hydraulic connector or a similar connector, so as to provide sufficient operating pressures to allow for functioning of the main and/or emergency control systems of the BOP 16.

As illustrated, the ROV panel 42 may be coupled via a connection 48 (e.g., a hose, a wire, or another connection) to the ROV panel 32 or a control system of the BOP 16. The support structure 36 may also include an ROV panel 50 that may be used to interface with an ROV to provide control by the ROV of one or more portions of the support structure 36. Furthermore, the ROV panel 42 and the ROV panel 50 may, in some embodiments, be combined into a single panel, in contrast with the illustrated embodiment in which the ROV panel 32 and the ROV panel 50 are disposed in physically distinct locations of the support structure 36.

The ROV panel 50 may be used to provide access to the ROV for control of an actuator 52 (e.g., primary control or secondary control when a controller or a control system, such as a controller or a control system of the BOP 16 and/or the support structure 36, provides primary control to selectively control operation of the actuator 52). The actuator 52 may selectively provide (based on received control signals) a unidirectional force, for example, to cause extension and retraction of a support member 54 (e.g., a foot or other support). In this manner, the actuator 52 may cause the support member 54 to contact and/or be driven into to the seafloor 14, as will be discussed in greater detail with respect to FIG. 3. Additionally, the actuator 52 may affect removal of the support member 54 from contact with the seafloor 14, as will be discussed with respect to FIG. 6. The support member 52 may operate to provide a foundation that helps distribute loads, at least attributable to the accumulators 40 and/or the stability frame 38, to the seafloor 14 (e.g., away from the BOP 16 and/or the wellhead 18). These loads may be in excess of approximately 4000 lbs., 5000 lbs., 6000 lbs., 7000 lbs., 8000 lbs., 9000 lbs., 10,000 lbs, or more.

In some embodiments, the actuator 52 may be a linear hydraulic motor, such as a hydraulic cylinder, a ram cylinder, a spud cylinder, a protracting cylinder, or the like. In some embodiments, the actuator may be driven by the hydraulics of the BOP 16 and controlled by a controller (e.g., a processor operating in conjunction with a memory, an application specific integrated circuit, or similar hydraulic or electronic circuitry that operates to receive at least one input and generate a respective control signal in response to that input to control operation of the actuator 52) of the support structure 36, a controller of the BOP 16 (e.g., a portion of a control system of the BOP 16), or by an ROV.

Figure 3:
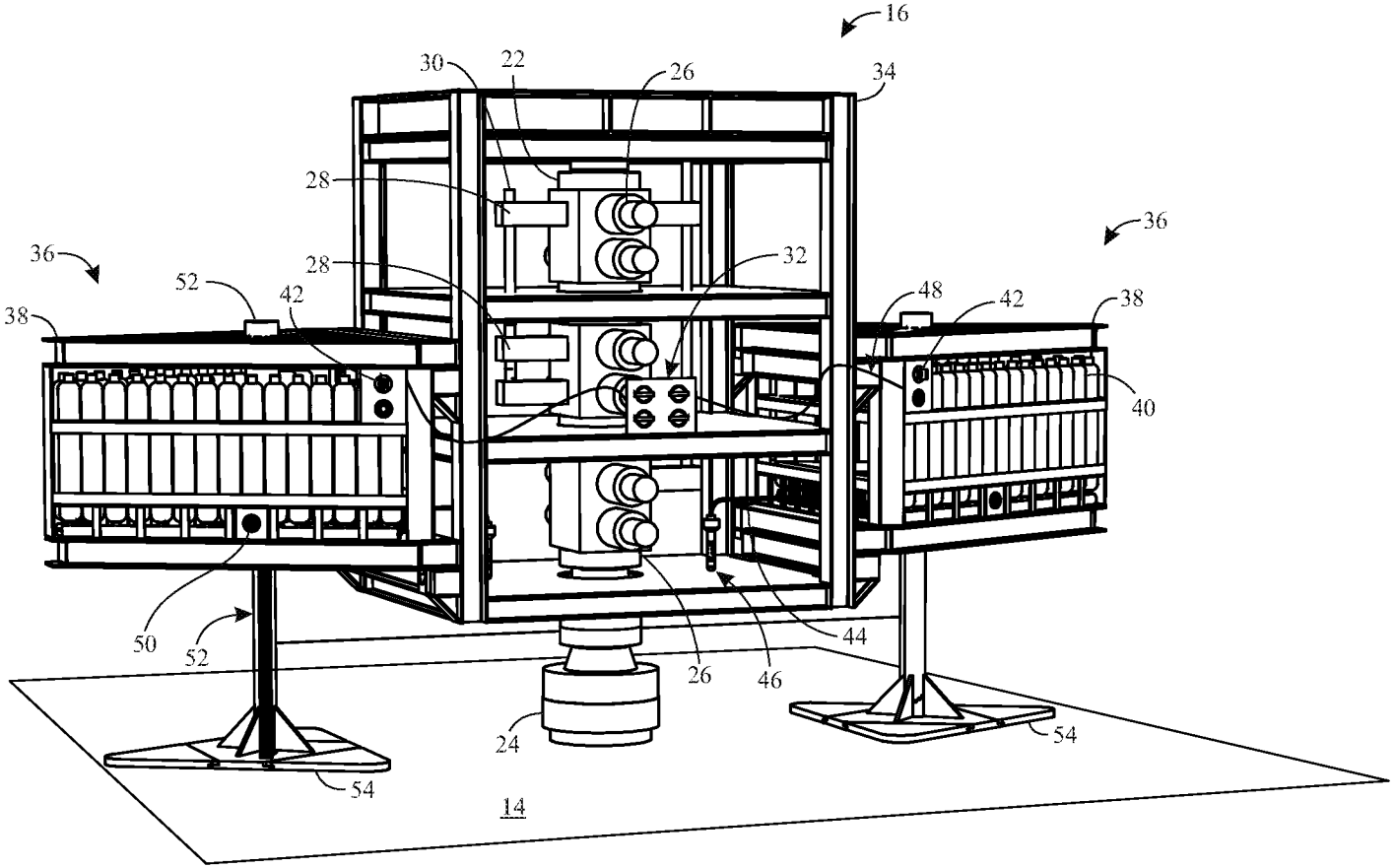
FIG. 3 illustrates a second front view of the BOP of FIG. 1, in accordance with an embodiment.

As previously described, FIG. 2 may illustrate the support structure 36 prior to deployment of the support member. Additionally, as illustrated in FIG. 3, the actuator 52 may cause the support member 54 to deploy and to contact and/or be driven into to the seafloor 14. In one embodiment, soil assessment of the seafloor 14 may be undertaken prior to at least the support member 54 being actuated to extend to the seafloor 14. This assessment may be used in determining the amount of force to supply to the support member 54 from the actuator 52 to contact and/or drive the support member 54 to a desired depth in the seafloor to allow for sufficient load support of, at least, the accumulators 40 and/or the accumulators 40 and the stabilizing frame 38, to reduce, minimize, and/or eliminate loads imparted to, for example, the wellhead 18.

In some embodiments, a single actuator 52 may cause two or more support members 54 to contact and/or be driven into to the seafloor 14. Alternatively, one actuator 52 of a plurality of actuators 52 may correspond to one support member 54 of a plurality of support members 54 (such that the number of actuators 52 correspond to the number of support members 54 in a 1:1 relationship). Multiple support members 54 may be utilized to, for example, better distribute the load across the stabilizing frame 38 and/or provide for contact points at different vertical elevations of the seafloor 14 to maintain level stability of the stabilizing frame 38.

Figure 4:
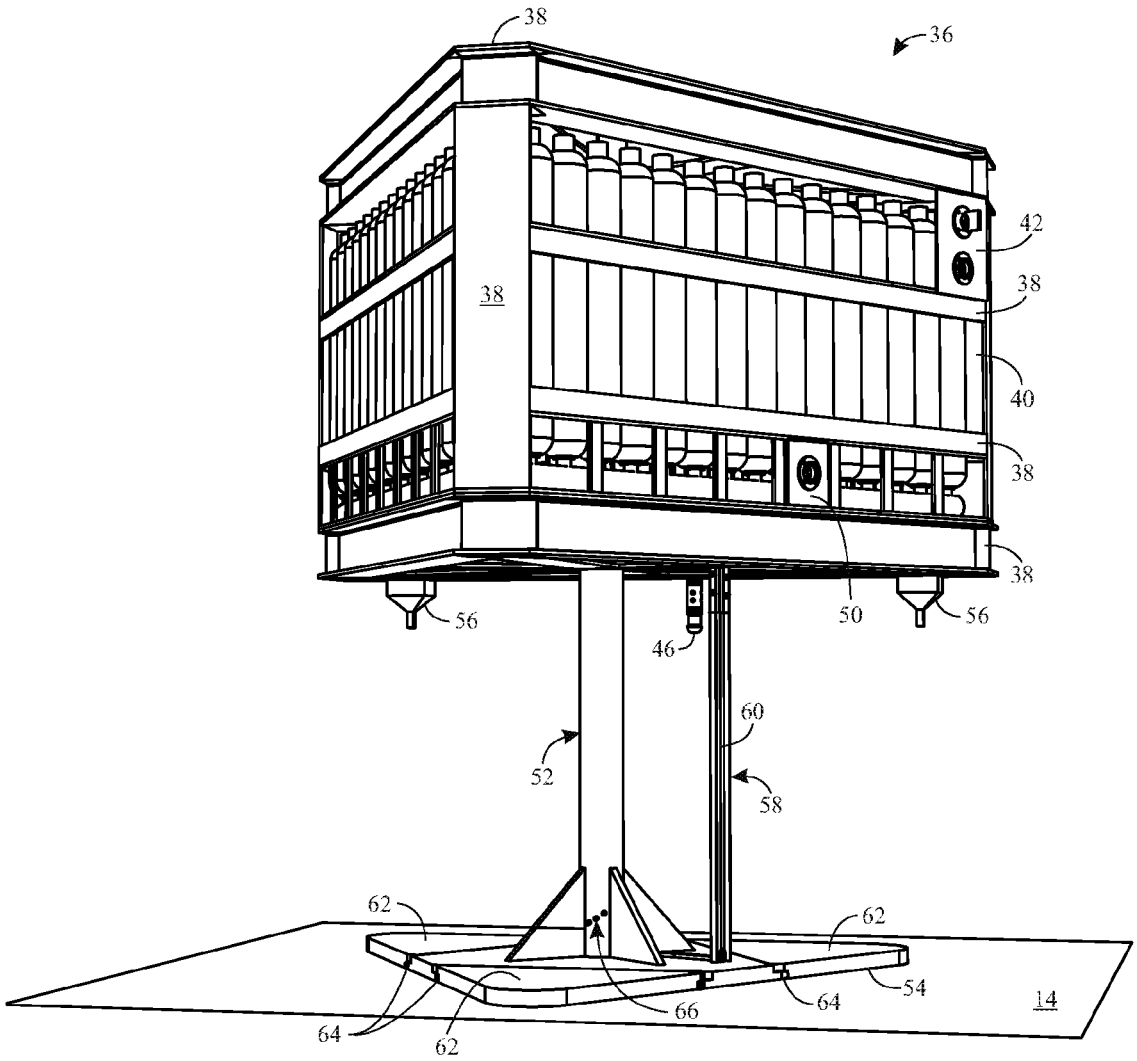
FIG. 4 illustrates a side view of the support structure of FIG. 2, in accordance with an embodiment.

Additionally, as further illustrated in FIG. 4, the stabilizing frame 38 may include one or more alignment members 56. The alignment members 56 may be pins that can be coupled to a slot (e.g., an engagement member) of the frame 34 to form an alignment joint to allow for aligned engagement of the stabilizing frame 38 and the frame 34. In other embodiments, the alignment members 56 may be disposed on the frame 34 and the slots (e.g., engagement members) may be disposed on the stabilizing frame 38 to form the alignment joint. As may be appreciated, other locking mechanisms or alignment mechanisms may be employed to form additional alignment joints in conjunction with the alignment members 56 and the slots. Likewise, other locking mechanisms or alignment mechanisms may be employed to replace the alignment members 56 and the slots to form the alignment joints.

FIG. 4 also illustrates a cable carrier 58 (e.g., a drag chain, an energy chain, a cable chain, or the like) coupled to the support member 54. The cable carrier 58 may enclose (e.g., surround) one or more connectors 60 (e.g., hydraulic hose, electrical wire, or the like) and may operate to extend and retract to allow for vertical movement of the connectors 60 in conjunction with the extension and retraction of the support member 54. In some embodiments, the connectors 60 may provide pressurized fluid or electrical signals to actuate motion of one or more segments 62 (in conjunction with hinges 64, e.g., retrieval hinges) to aid in the removal of the support member 54 from the seafloor 14. Likewise, one or more flow apertures 66 (e.g., relief vents) may transmit pressurized fluid (e.g., received from a connectors 60) to provide a rotational force to aid in removal of the support member 54 from the seafloor 14. The flow apertures 66 may operate separately from and/or in conjunction with actuation of the segments 62 to assist in the removal of the support member 54 from the seafloor 14 by actuator 52.

Figure 5:
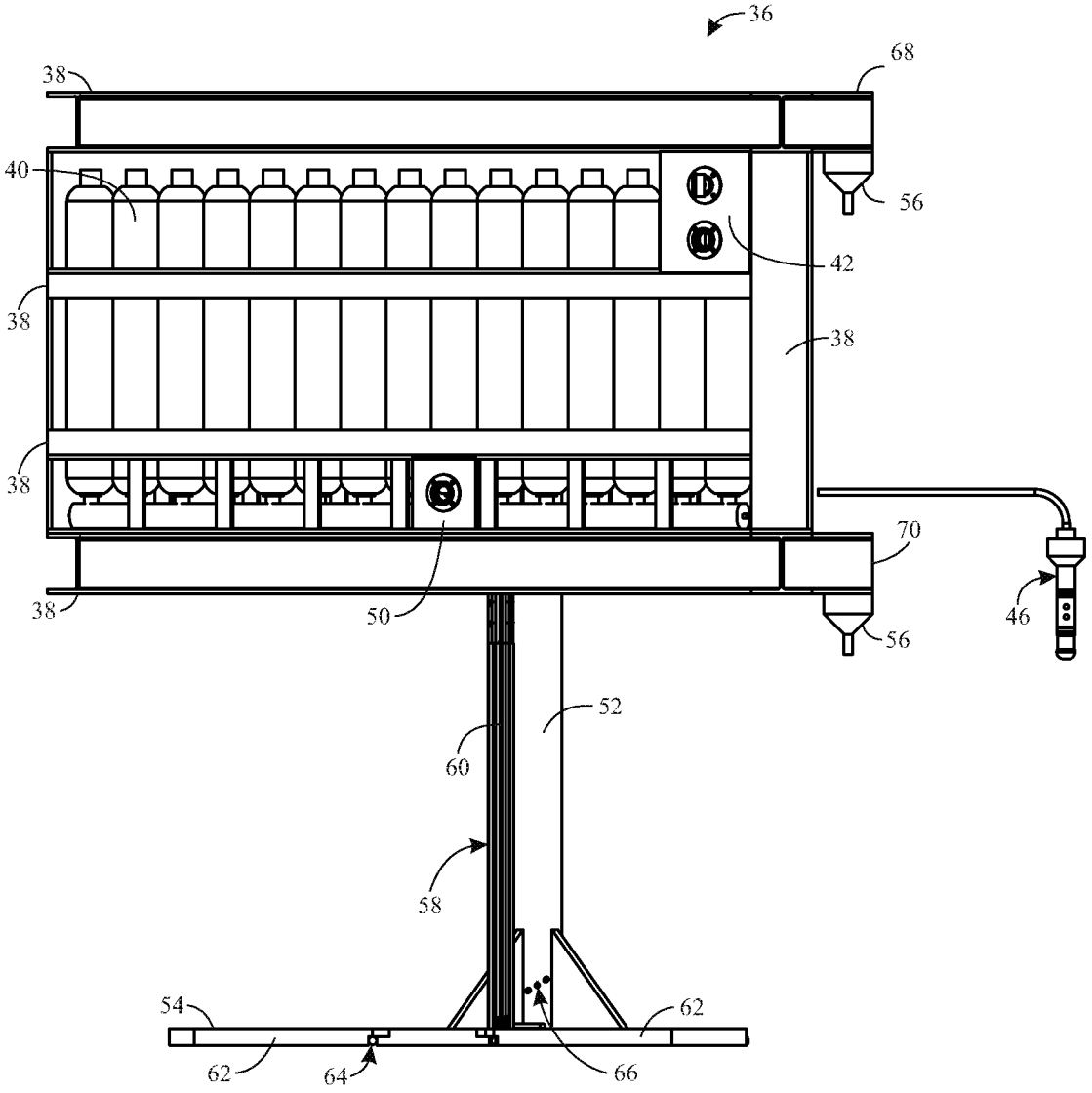
FIG. 5 illustrates a rear view of the support structure of FIG. 2, in accordance with an embodiment.

In FIG. 5, an additional view of the support structure 36 is illustrated. As illustrated, an additional alignment member 56 may be present along an upper portion 68 of the stabilizing frame 38. In this manner, alignment members 56 may be present in both an upper portion 68 of the stabilizing frame 38 as well as in a lower portion 70 of the stabilizing frame 38. Utilization of alignment members 56 along different vertical positions of the stabilizing frame 38 may allow for increased stability during connection of the stabilizing frame 38 with the frame 34.

Figure 6:
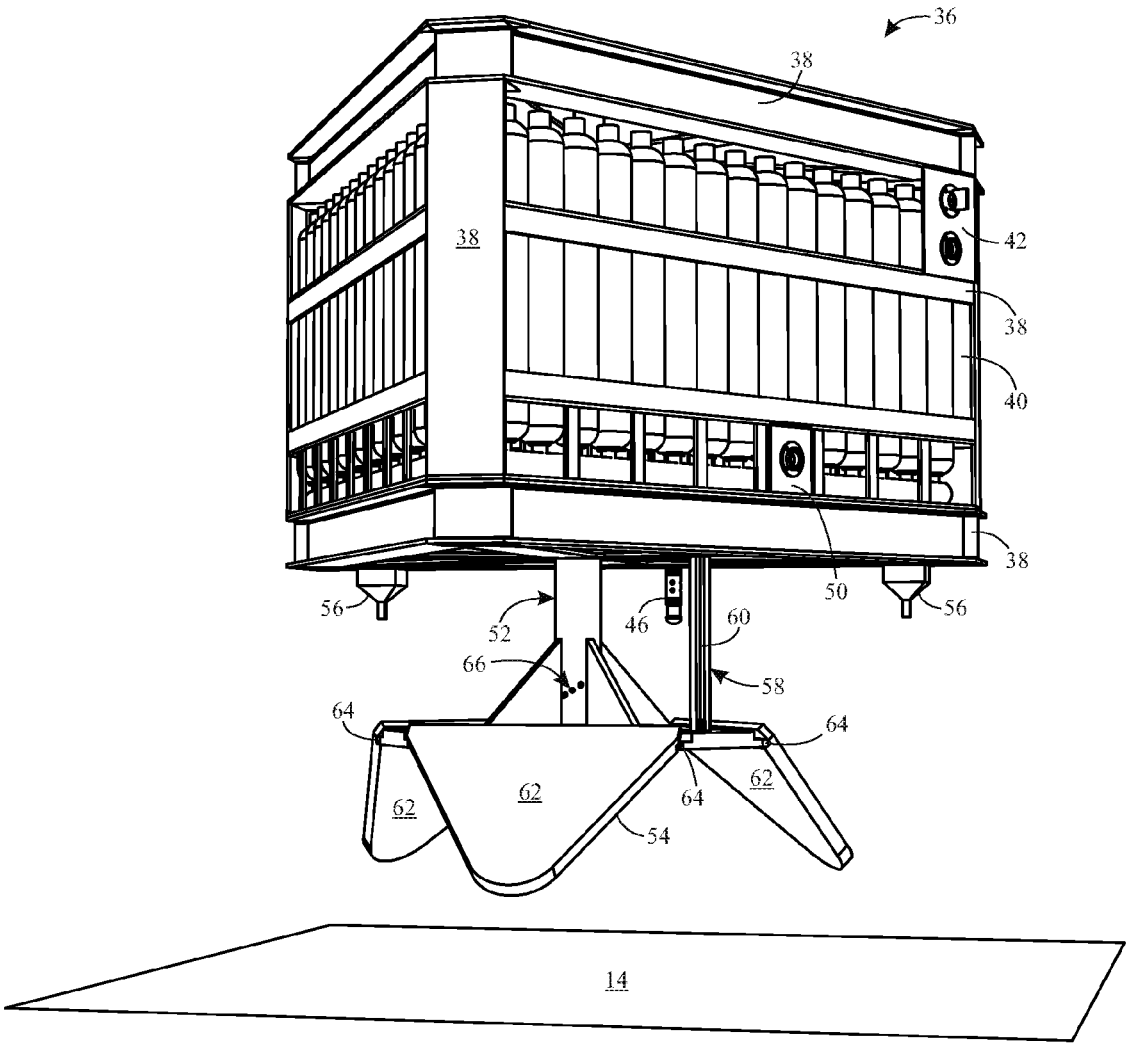
FIG. 6 illustrates a second side view of the support structure of FIG. 2, in accordance with an embodiment.

FIG. 6 illustrates an additional view of the support structure 36. As illustrated, the support structure 36 is retracted from the seafloor 14 consistent with the techniques described above. For example, actuator 52 (in whole or in part) may cause the support member 54 to retract from the seafloor 14. This retraction (e.g., extraction) of the support member 54 may be also be accompanied with retraction of the cable carrier 58 (and, accordingly, the one or more connectors 60) in conjunction with the vertical movement of the support member 54 towards the stabilizing frame 38 and away from the seafloor 14 (e.g., in conjunction with the retraction of the support member 54).

Additionally, FIG. 6 illustrates the segments 62 of the support member 54 as having been actuated to allow for the retraction of the support member 54 from the seafloor 14. Likewise, one or more flow apertures 66 (e.g., relief vents) may have transmitted pressurized fluid (e.g., received from a connectors 60) to provide a rotational force to aid in removal of the support member 54 from the seafloor 14 separately from and/or in conjunction with the actuation of the segments 62 to assist in the removal of the support member 54 from the seafloor 14 by the actuator 52. In some embodiments, the segments 62 may be repositioned into the position illustrated in FIG. 2 during and/or subsequent to the vertical movement of the support member towards the stabilizing frame 38. In this manner, the actuator 52 may operate to selectively deploy (e.g., as being controlled via at least one control signal) the support member 54 from a first position adjacent to the stabilizing frame 38 (e.g., the position of the support member 54 as illustrated in FIG. 2) to a second position in which the support member 54 contacts or is disposed within the seafloor 14 (e.g., the position of the support member 54 illustrated in FIGS. 3-5). Likewise, the actuator 52 (along with, for example, the segments 62 and the flow apertures 66) may operate to retract the support member 54 from the second position in which the support member 54 contacts or is disposed within the seafloor 14 to the first position in which the support member is adjacent to the stabilizing frame 38.

It should also be noted that the support structure 36 may further include a spring clutch that may be disposed internal to or separate from the actuator 52. The spring clutch (e.g., one way spring) may include an input hub that may impart force to a spring, causing the spring to rotate a second hub coupled to the spring in the direction of the spring helix force. Stopping rotation of the input hub (or reversing the rotation of the input hub) may cause the spring to unwrap (releasing the output hub in the process). In this manner, the spring clutch is unidirectional and may provide an additional rotational force (in addition to or separate from the force imparted by the flow apertures 66) to aid in removal of the support member 54 from the seafloor 14 (e.g., from the second position of the support member 54, as illustrated in FIGS. 3-5).

Figure 7:
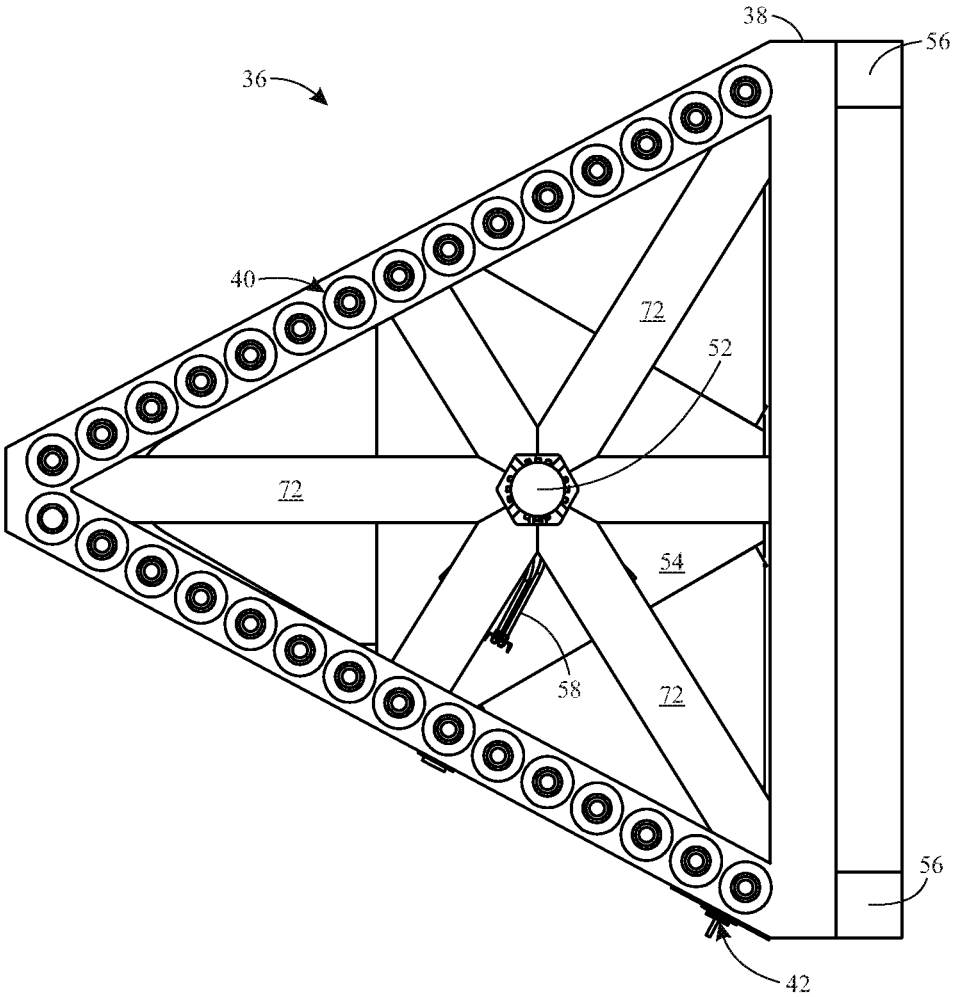
FIG. 7 illustrates a top view of the support structure of FIG. 2, in accordance with an embodiment.

A top view of the support structure 36 is illustrated in FIG. 7. As illustrated, the support structure 36 includes one or more beams 72 as a portion of the stabilizing frame 38. Also, as illustrated, the beams 72 may form apertures therebetween, for example, to reduce drag during deployment and/or extraction (retraction) of the support structure 36. Additionally, as illustrated, the stabilizing frame 38 has a generally or substantially triangular shape. However, other shapes including circular, ovoid, elliptical quadrilateral, pentagonal, hexagonal, heptagonal, octagonal, and additional shapes may be used for the support structure 36 (e.g., for one or both of the one or both of the stabilizing frame 38 and the support member 54). In some embodiments, the shape of the stabilizing frame 38 and the support member 54 may be similar or identical. In other embodiments, the shape of the stabilizing frame 38 and the support member 54 may differ from one another. Likewise, while the support structure 36 is illustrated as including apertures between beams 72, in some embodiments, these apertures may be covered and/or the beams 72 may sized to prohibit any apertures therebetween. Likewise, while accumulators 40 are illustrated as being disposed along an outer perimeter of the stabilizing frame 38, in other embodiments, the accumulators 40 may be additionally and/or alternatively disposed in additional locations in the support structure (e.g., along beams 72, along a covering between beams 72, or the like) as necessary (e.g., based upon amount of area available in the support structure, the amount of pressurized fluid present in the accumulators 40, and/or demands of the BOP 16).

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

an auxiliary frame configured to be coupled to an outer portion of a blowout preventer (BOP) frame that encloses at least a portion of a BOP such that the auxiliary frame is disposed about the outer portion of the BOP frame, wherein the auxiliary frame is configured to house a plurality of accumulators to provide pressurized fluid to the BOP for use by the BOP in an operation, wherein the auxiliary frame comprises a support member configured to extend from the auxiliary frame to support a load associated with the plurality of accumulators.

2. The device of claim 1, wherein the auxiliary frame comprises at least one cantilevered beam configured to be coupled to the BOP frame.

3. The device of claim 1, comprising at least one fastening mechanism configured to releasably couple the auxiliary frame to the BOP frame.

4. The device of claim 1, comprising at least one fixed connection configured to fixedly couple the auxiliary frame to the BOP frame.

5. The device of claim 1, wherein the auxiliary frame comprises an alignment member configured to mate with an engagement member of the BOP frame to form an alignment joint.

6. The device of claim 1, comprising a remotely operated vehicle (ROV) panel configured to interface with an ROV to allow the ROV to control at least one operation of the device.

7. The device of claim 6, wherein the ROV panel is configured to interface with the ROV to allow the ROV to control operation of an actuator of the device as the operation of the device.

8. The device of claim 6, wherein the ROV panel is configured to interface with the ROV to allow the ROV to control operation of at least one accumulator of the plurality of accumulators as the operation of the device.

9. The device of claim 1, wherein the support member is configured to extend from the auxiliary frame to couple the device to a seafloor.

10. The device of claim 1, wherein the auxiliary frame comprises a substantially triangular shape.

11. A system, comprising:

an auxiliary frame configured to be coupled to an outer portion of a blowout preventer (BOP) frame such that the auxiliary frame is disposed about the outer portion of the BOP frame;

a support member coupled to the auxiliary frame and configured to extend from the auxiliary frame to couple the auxiliary frame to a seafloor, wherein the support member is configured to support a load associated with a plurality of accumulators housed in the auxiliary frame, wherein the plurality of accumulators are configured to provide pressurized fluid to a BOP associated with the BOP frame for use by the BOP in an operation; and an actuator configured to selectively deploy the support member from a first position adjacent to the auxiliary frame to a second position in which the support member is coupled to the seafloor.

12. The system of claim 11, wherein the actuator is configured to selectively retract the support member from the second position to the first position.

13. The system of claim 12, comprising a controller configured to:

control the selective deployment of the support member by the actuator; and control the selective retraction of the support member by the actuator.

14. The system of claim 13, wherein the controller is configured to cause the actuator to deploy the support member with a first force based upon results from a soil assessment of the seafloor.

15. The system of claim 12, wherein the support member comprises a segment configured to actuate to assist in the selective retraction of the support member from the second position to the first position.

16. The system of claim 12, comprising a flow aperture configured to channel a fluid in a direction to assist in the selective retraction of the support member from the second position to the first position.

17. The system of claim 12, comprising a remote operated vehicle (ROV) panel configured to interface with an ROV to allow the ROV to:

control the selective deployment of the support member by the actuator; and control the selective retraction of the support member by the actuator.

18. A method, comprising:

selectively deploying a support member from a first position adjacent to an auxiliary frame configured to be coupled to an outer portion of a blowout preventer (BOP) frame to a second position in which the support member is coupled to a seafloor; and supporting, via the support member, a load associated with a plurality of accumulators housed in the auxiliary frame, wherein the plurality of accumulators are configured to provide pressurized fluid to a BOP associated with the BOP frame for use by the BOP in an operation.

19. The method of claim 18, comprising selectively retracting the support member from the second position to the first position.

20. The method claim 18, comprising coupling the auxiliary frame to the outer portion of the BOP frame.

* * * * *